US012577768B2

(12) United States Patent
Gunawardena et al.

(10) Patent No.: US 12,577,768 B2
(45) Date of Patent: Mar. 17, 2026

(54) TOUCHLESS TOILET ASSEMBLY

(71) Applicant: AS America, Inc., Piscataway, NJ (US)

(72) Inventors: Mahendra Gunawardena, Hillsborough, NJ (US); Robert M. Jensen, East Brunswick, NJ (US)

(73) Assignee: AS America, Inc., Piscataway, NJ (US)

( * ) Notice: Subject to any disclaimer, the term of this patent is extended or adjusted under 35 U.S.C. 154(b) by 378 days.

(21) Appl. No.: 18/098,826

(22) Filed: Jan. 19, 2023

(65) Prior Publication Data

US 2023/0228075 A1 Jul. 20, 2023

Related U.S. Application Data

(60) Provisional application No. 63/301,110, filed on Jan. 20, 2022.

(51) Int. Cl.

| | |
|---|---|
| ***E03D 1/08*** | (2006.01) |
| ***E03D 1/32*** | (2006.01) |
| ***E03D 1/34*** | (2006.01) |
| ***E03D 5/10*** | (2006.01) |

(52) U.S. Cl.

CPC ..... *E03D 1/087* (2013.01); *E03D 1/32* (2013.01); *E03D 1/34* (2013.01); *E03D 5/105* (2013.01)

(58) Field of Classification Search

CPC .... E03D 1/04; E03D 1/08; E03D 1/06; E03D 1/085; E03D 1/087; E03D 5/105; E03C 1/057

See application file for complete search history.

(56) References Cited

U.S. PATENT DOCUMENTS

| | | | | |
|---|---|---|---|---|
| 9,657,471 | B2 | 5/2017 | Denzin et al. | |
| 10,851,532 | B2 | 12/2020 | Denzin et al. | |
| 2017/0183853 | A1* | 6/2017 | Crist | E03D 5/105 |
| 2018/0010322 | A1* | 1/2018 | Grover | G01S 15/88 |
| 2019/0087788 | A1* | 3/2019 | Murphy | E03D 5/105 |

FOREIGN PATENT DOCUMENTS

| | | | | |
|---|---|---|---|---|
| CA | 3106994 | A1 * | 2/2020 | E03C 1/00 |
| GB | 456017 | A * | 11/1936 | |
| GB | 2270528 | A * | 3/1994 | E03D 1/087 |
| WO | 2018085867 | A1 | 5/2018 | |
| WO | WO-2020005660 | A1 * | 1/2020 | E03D 1/012 |

* cited by examiner

*Primary Examiner* — Erin Deery

(74) *Attorney, Agent, or Firm* — Anna-lisa L. Gallo; Tyler A. Stevenson

(57) ABSTRACT

A touchless siphon valve assembly for a toilet assembly having a toilet tank, the touchless siphon valve assembly comprising a control assembly and a siphon valve assembly, wherein the control assembly comprises a capacitive sensor, a controller, and a power source, and the siphon valve assembly comprises a tubular core, a head coupled to and surrounding an upper end of the tubular core, a spray initiator positioned in the head and extending into the tubular core, and a solenoid valve fluidly coupled to the spray initiator, the capacitive sensor is configured to detect a user gesture, and to indicate detection of the first gesture to the controller to initiate a flush cycle.

17 Claims, 7 Drawing Sheets

TOUCHLESS TOILET ASSEMBLY

The disclosure relates to a touchless toilet assembly, in particular to a touchless toilet assembly comprising a tank and siphon valve.

BACKGROUND OF THE DISCLOSURE

In an effort to improve hygiene, desired are toilets for residential use which may be flushed on-demand without one having to touch handle, lever, or button in order to initiate a flush. A toilet tank not having a handle, lever, or button also provides greater freedom regarding design of toilet tanks. For a touchless toilet system, it is also desired that an electrically-powered flush system have few or no moving parts to reduce strain on the system.

SUMMARY

Accordingly, disclosed is a touchless toilet assembly comprising a toilet tank, the toilet tank comprising a control assembly; and a siphon valve assembly, wherein the control assembly comprises a capacitive sensor, a controller, and a power source, and the siphon valve assembly comprises a tubular core, a head coupled to and surrounding an upper end of the tubular core, a spray initiator positioned in the head and extending into the tubular core, and a solenoid valve fluidly coupled to the spray initiator, and wherein the power source is electrically connected to the capacitive sensor, the controller, and the solenoid valve, the capacitive sensor is configured to detect a first gesture, and to indicate detection of the first gesture to the controller to initiate a flush cycle, the controller, upon receiving indication of the first gesture from the capacitive sensor, is configured to instruct the solenoid valve to open, the spray initiator, upon opening of the solenoid valve, is configured to spray pressurized water on an entire perimeter of a tubular core inner surface to form a water seal, thereby creating negative pressure in the tubular core and initiating a siphon flow of surrounding water in the toilet tank.

Also disclosed is a touchless siphon valve assembly for a toilet assembly having a toilet tank, the touchless siphon valve assembly comprising a control assembly; and a siphon valve assembly, wherein the control assembly comprises a capacitive sensor, a controller, and a power source, and the siphon valve assembly comprises a tubular core, a head coupled to and surrounding an upper end of the tubular core, a spray initiator positioned in the head and extending into the tubular core, and a solenoid valve fluidly coupled to the spray initiator, and wherein the power source is electrically connected to the capacitive sensor, the controller, and the solenoid valve, the capacitive sensor is configured to detect a first gesture, and to indicate detection of the first gesture to the controller to initiate a flush cycle, the controller, upon receiving indication of the first gesture from the capacitive sensor, is configured to instruct the solenoid valve to open, the spray initiator, upon opening of the solenoid valve, is configured to spray pressurized water on an entire perimeter of a tubular core inner surface to form a water seal, thereby creating negative pressure in the tubular core and initiating a siphon flow of surrounding water in a toilet tank.

BRIEF DESCRIPTION OF THE DRAWINGS

The disclosure described herein is illustrated by way of example and not by way of limitation in the accompanying figures. For simplicity and clarity of illustration, features illustrated in the figures are not necessarily drawn to scale. For example, the dimensions of some features may be exaggerated relative to other features for clarity. Further, where considered appropriate, reference labels have been repeated among the figures to indicate corresponding or analogous elements.

DETAILED DISCLOSURE

A siphon flush valve may include a tubular core, a head and a spray initiator. A head and core may be concentric and a spray initiator may be positioned at the top of a siphon flush valve. In use, a flush valve may be positioned in a tank with a starting tank water level sufficient to reach towards a top of the head. To initiate operation of a flush valve, pressurized water initiates a spray into the core creating a pressure differential within the core causing the tank water to rise up in the head and spill over a valve weir into the core. This establishes a siphon flow of water for discharge into the toilet bowl for flushing the bowl and removing waste. Once full siphon flow is established through the valve, the pressurized water may be turned off. As the tank water discharges, the tank water level goes down to an ending water level generally at the bottom of the head thereby allowing air to enter into the head to break the siphon. A fill valve may be provided and configured to refill the toilet tank to allow subsequent repeat flush cycles. Details of various exemplary implementations of a siphon flush valve are discussed below with reference to the figures.

Figure 1A:
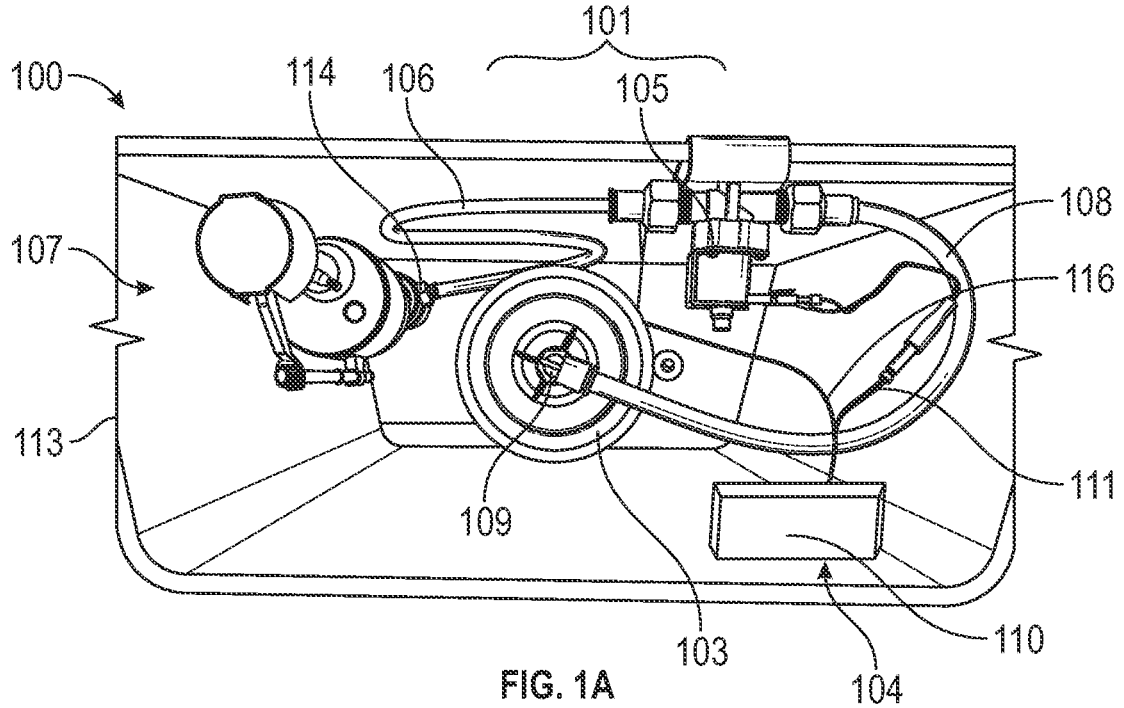
FIG. 1A and FIG. 1B show a toilet tank assembly comprising a siphon valve assembly, according to an embodiment.
Figure 1B:
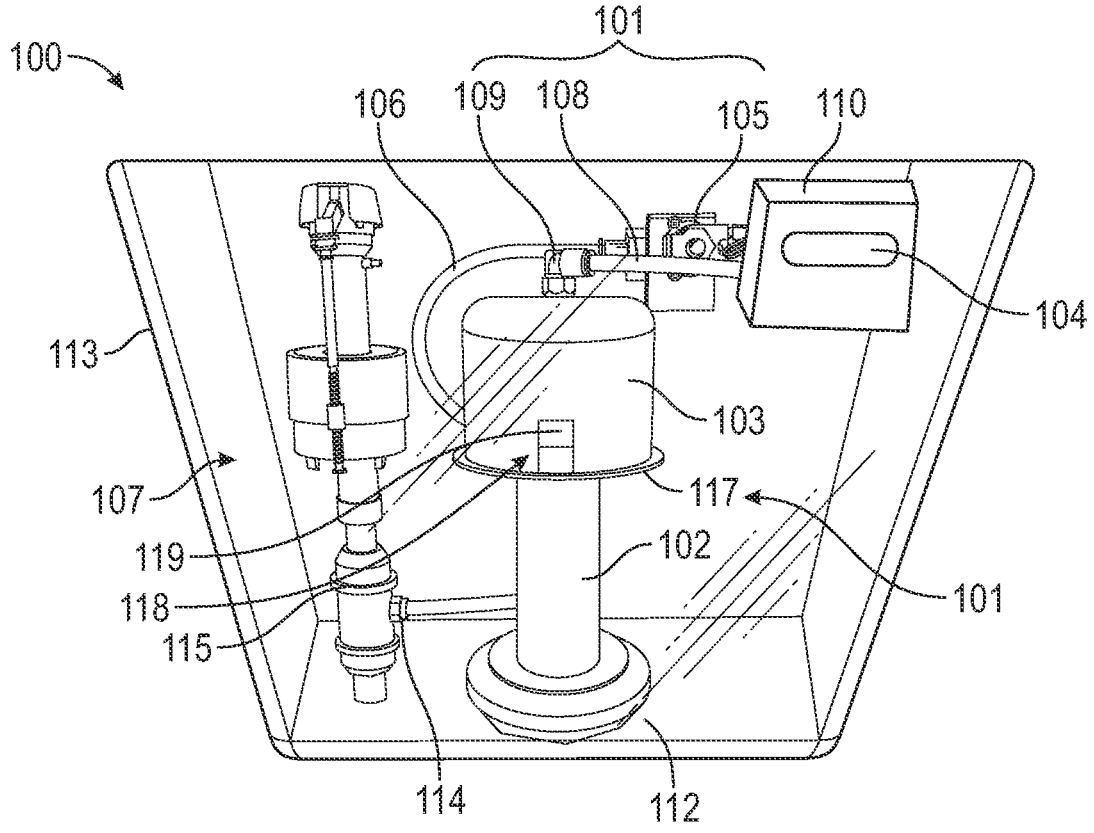

FIG. 1A and FIG. 1B depict toilet tank assembly 100 in top and front views, respectively, according to one embodiment. Siphon valve assembly 101, positioned in tank 113, comprises tubular core 102, dome-shaped head 103, and solenoid valve 105. Solenoid valve 105 is fluidly coupled to spray initiator 109 positioned in head 103 via second water supply line 108. Solenoid valve 105 is also fluidly coupled to fill valve 107 via first water supply line 106. First water supply line 106 is coupled to fill valve 107 via port 114 below (upstream of) fill valve outlet 115, such that supply line 106 is under water pressure. Capacitive sensor 104 is positioned on an exterior of housing 110, and in contact with an inner wall of tank 113 and an outer wall of housing 110. Housing 110 and/or capacitive sensor 104 may be affixed to tank 113 inner wall via an adhesive or other means. Housing 110 comprises a battery and a controller (not visible). Sensor 104 is in wired electrical communication with the battery and the controller in housing 110. The controller is electrically connected to solenoid 105 via wire 111. Housing 110 will be positioned above a tank standing water level, which water level will typically be positioned between a top and bottom 117 of head 103 between flush cycles.

Upon a person indicating a gesture near sensor 104, the controller is configured to receive indication of the gesture, and to send instruction to solenoid 105 to open to supply pressurized water to spray initiator 109 to start a flush cycle. Spray initiator 109 delivers pressurized water into tubular core 102 and onto an entire perimeter thereof, which creates reduced (negative pressure/vacuum) in tubular core 102. Negative pressure initiates siphon flow through inlet 117, through tubular core 102, and out outlet 112 to a bowl to perform a flush.

Cap 103 comprises opening 118 comprising door or "gate" 119 slideably positioned therein. Gate 119 is configured to move or "slide" vertically relative to opening 118. Gate 119 is shown in an open position, wherein a lower portion of opening 118 is open to tank 113 interior. During a flush cycle, tank water flows through inlet 117 and outlet 112 to a bowl. With opening 118 closed, when the tank water level drops to the lower point of head 103, air will enter inlet 117, thereby breaking the siphon and ending the flush. With opening 118 open, as shown, air will enter head 103 when the tank water level drops to the bottom point of gate 119, thereby breaking the siphon and ending the flush.

Accordingly, with one or more doors or gates such as gate 119 positioned in a flush valve head, an assembly may be configured to perform flush cycles with varying volumes of water. For example, a flush valve assembly may be configured to perform a high volume or "full" flush to clear a bowl of solid matter, and a low volume or "short" flush to clear a bowl of non-solid (liquid) matter. In some embodiments, a full flush may provide for a flush volume of from about 3.0 liters to about 9.0 liters, and a low volume flush may provide a flush volume of from about 2.0 liters to about 4.5 liters.

In an embodiment, gate 119 is coupled to a mechanism configured to open and close it. A gate mechanism, for example an electric motor or solenoid, configured to open and close gate 119 may be electrically connected to a battery and a controller in housing 110 via wire 116. In some embodiments, a person may perform a first gesture to indicate a low flush is desired. In some embodiments, a person may perform a second gesture to indicate a full flush is desired.

Figure 2:
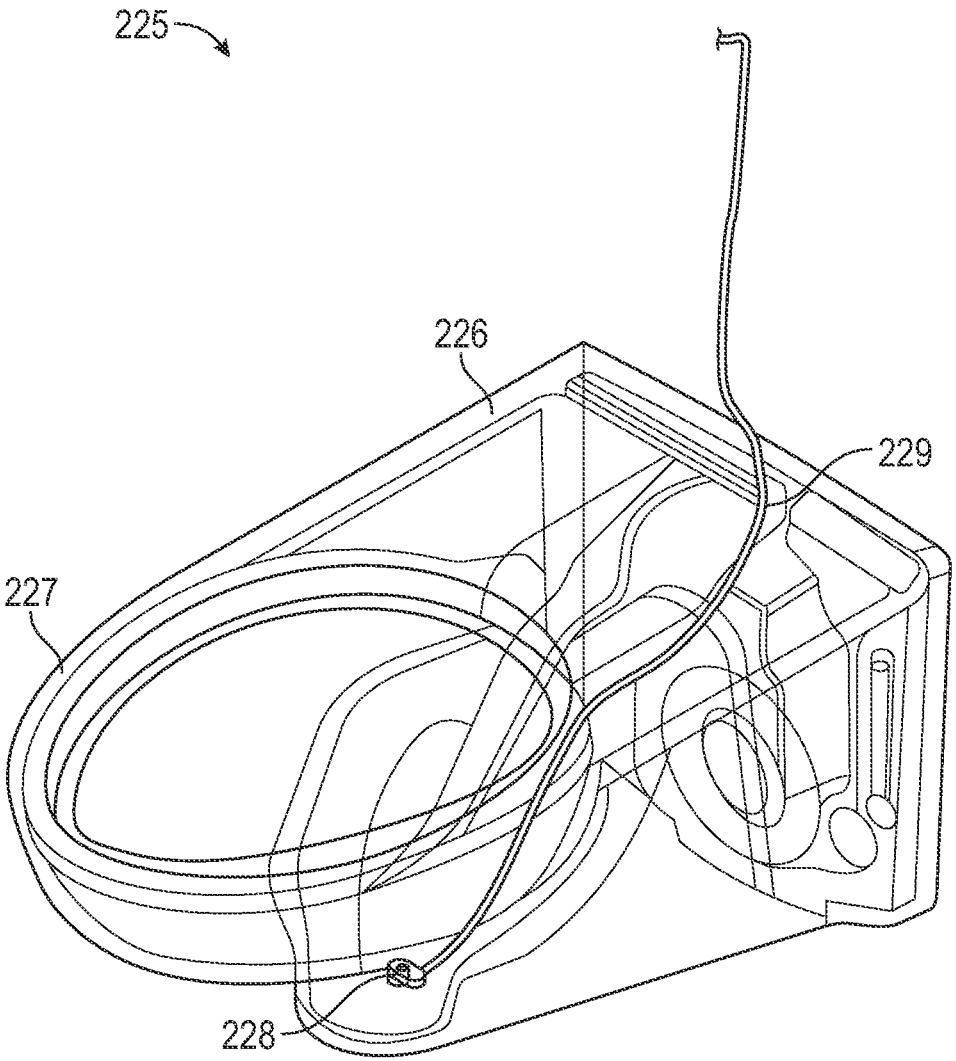
FIG. 2 provides a see-through view of a toilet assembly, according to an embodiment.

FIG. 2 provides a see-through view of toilet assembly 225, according to an embodiment. In an embodiment, tank assembly 100 may be coupled to deck 226. Ultrasonic sensor 228 is coupled to an exterior underside of bowl 227. Ultrasonic sensor 228 may be electrically coupled to a controller positioned in a tank via wire 229. Ultrasonic sensor 228 may be adhered to bowl 227 underside with an adhesive. Sensor 228 may be positioned directly under a bowl water seal.

Figure 3:
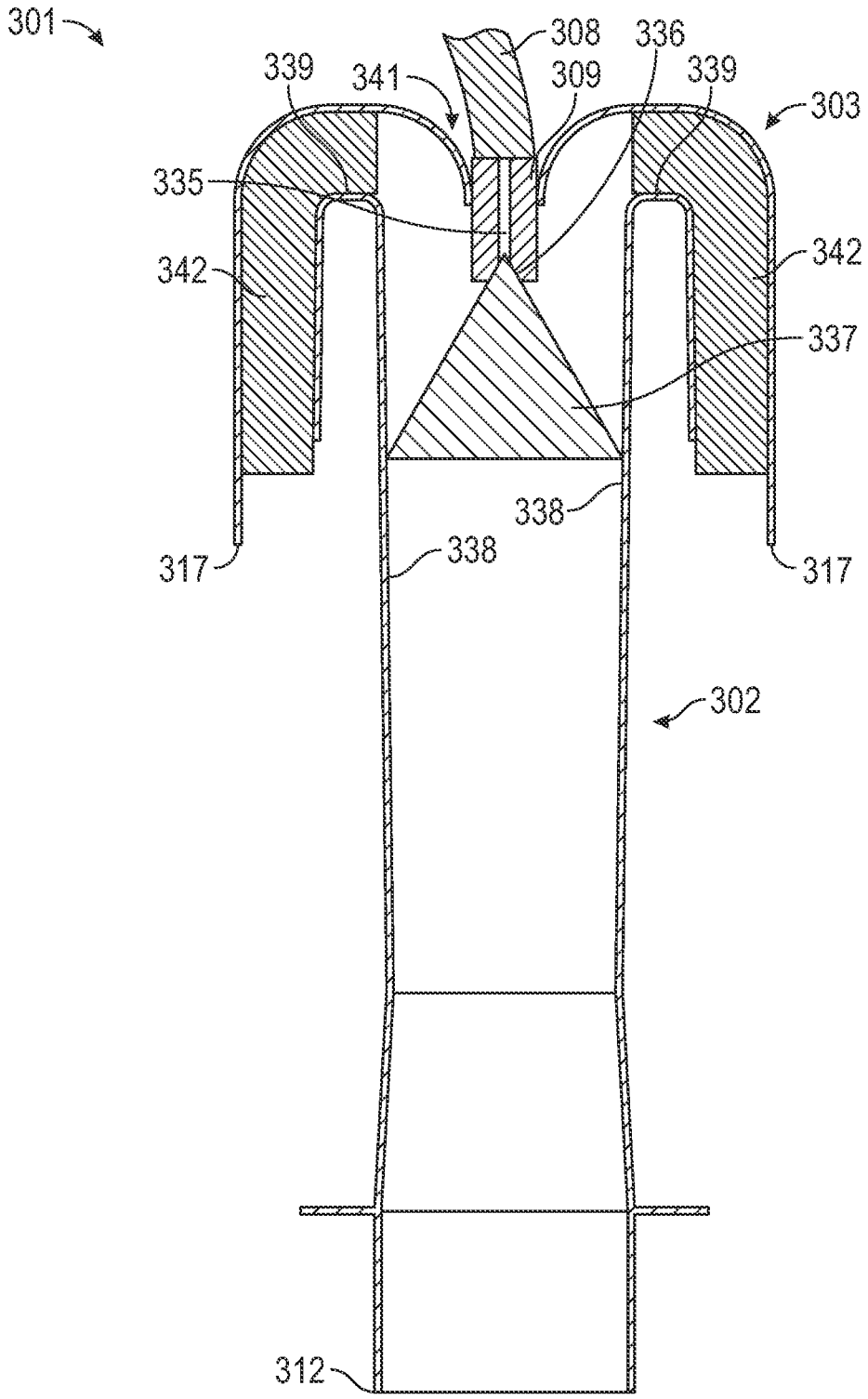
FIG. 3 shows a siphon flush valve in cross-section, according to an embodiment, including showing spray from a fluid supply line and a spray initiator.

FIG. 3 depicts a cutaway view of a portion of flush valve assembly 301 according to an embodiment. Assembly 301 comprises tubular core 302 and dome-shaped head 303. Disposed in head 303 is spray initiator 309. Initiator 309 comprises substantially constant diameter portion 335 and outwardly tapered portion 336. Outwardly tapered portion 336 may be substantially cone-shaped and configured for water to discharge from initiator 309 in a substantially cone shape 337 into core 302 and onto interior wall 338 of core 302. An outwardly tapered portion may provide an angle of spray between about 50 degrees and about 120 degrees. A surrounding fluid of a toilet tank may have a level between weir 339 and flush valve inlet 317 between flush cycles. Upon initiation of a siphon, surrounding fluid will enter inlet 317, pass over weir 339, through tubular core 302 and to a bowl (not shown) via outlet 312 to initiate a flush. As surrounding tank water level drops, the siphon will break when air enters inlet 317 and a flush will stop. Core 302 curves outward at weir 339 and extends longitudinally downward from the weir. Head 303 and an upper portion of core 302 are substantially concentric. Head 303 may comprise a concave section 341 surrounding initiator 309 and fluid supply line 308. The cutaway view of assembly 301 shows splines 342 disposed in head 303. Splines are further described in FIG. 4.

Figure 4:
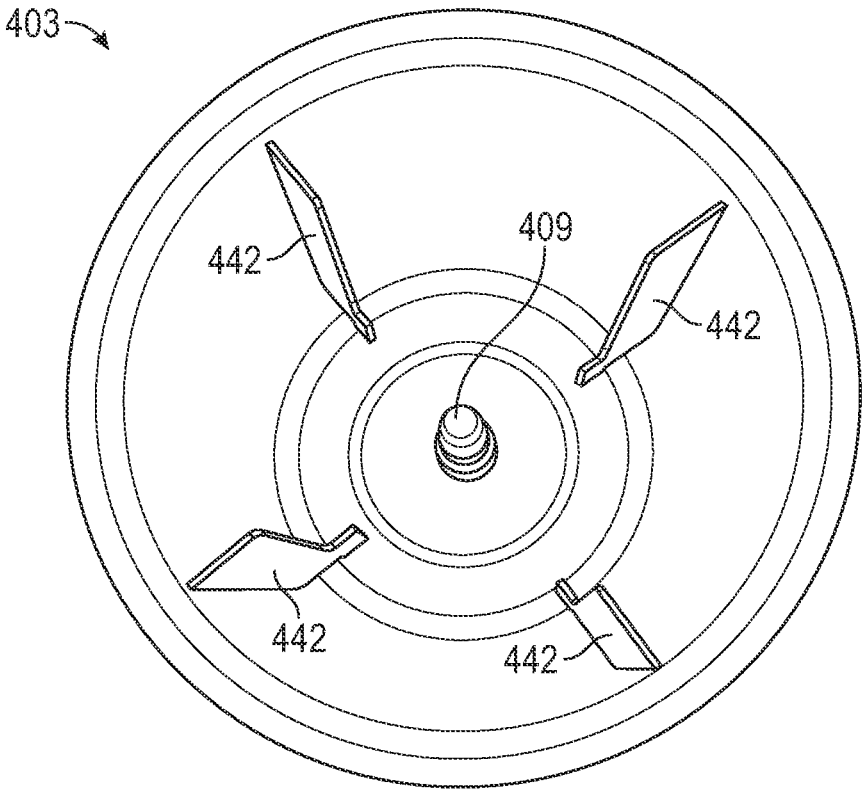
FIG. 4 shows an underside of a siphon valve head, according to an embodiment.
Figures 5A, 5B, 5C, 5D:
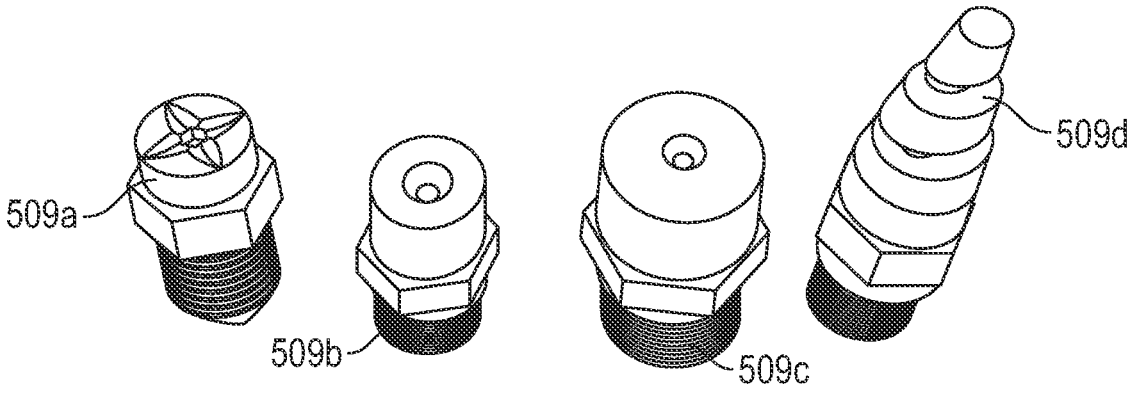
FIG. 5A, FIG. 5B, FIG. 5C, and FIG. 5D show a spray initiator of a siphon flush valve, according to certain embodiments.

FIG. 4 shows siphon valve head 403 from an underside, according to an embodiment. Head 403 comprises a dome or cap shape. An opening in head 403 is fitted with spray initiator 409. Head 403 has a plurality of splines 442 extending from an inner surface thereof. Although four splines 442 are depicted, more or fewer splines 442 may be provided. Splines 442 may locate and hold head 403 in place on an upper portion of a tubular core. Splines 442 may rest on an upper portion of a tubular core. Alternatively, splines 442 may provide a friction fit with an upper portion of a tubular core. Alternatively, splines 442 may be secured with other connection types (e.g. adhesion or fastening) to a tubular core. Splines 442 may be generally L-shaped. Splines 442 may extend from a top inner surface and/or inner wall surface. Splines 442 may be coupled to a top inner surface and inner wall surface of head 403. Splines 442 may be molded or formed with head 403. Alternatively, splines 442 may be formed separately and coupled to head 403, for example, by gluing or fastening. Splines 442 may be full length, extending along the entire length of head 403, or splines 442 may be partial length, extending along a portion of the length of head 403. Splines 442 may be configured to centrally locate head 403 on a tubular core. Splines 442 may extend to top of head 403 and may aid in determining a vertical head position. Splines 442 may create a radially and vertically extending space (a flow path) between an upper portion of a core and an inner surface of head 403. A radially and vertically extending space may be an annular space. An annular space between upper portion of a core and an inner surface of head 403 may be configured for water to flow into a siphon flush valve, through an inlet, over a weir, and into a tubular core. A configuration of splines 442 may vary depending upon a desired annular space and flow path.

Figures 6A, 6B, 6C:
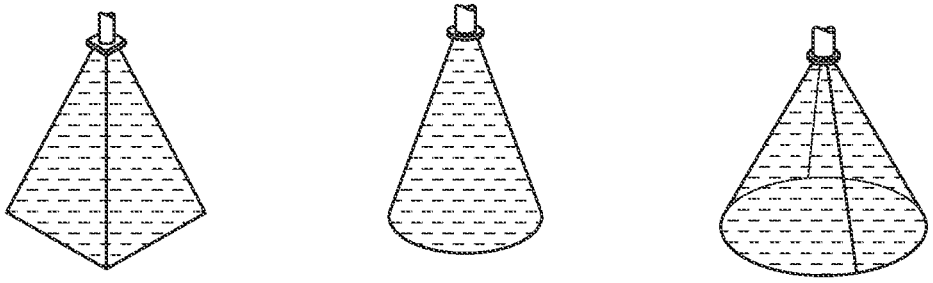
FIG. 6A, FIG. 6B, and FIG. 6C show spray patterns of spray initiators, according to some embodiments.

FIG. 5A, FIG. 5B, FIG. 5C and FIG. 5D, show spray initiators 509*a*, 509*b*, 509*c*, and 509*d*, according to certain embodiments. Spray initiators 509*a*, 509*b*, 509*c*, and 509*d* comprise a central bore. Spray initiator 509*d* is a "pigtail" initiator. A bore may comprise a shape that provides a certain shaped fluid spray, for instance a substantially square or pyramid-shaped spray, such as depicted in FIG. 6A, and which may be provided by spray initiator 509*a*. Initiator 509*b* may have a bore shape that may provide a substantially cone-shaped spray, such as a solid cone-shaped spray as depicted in FIG. 6B. Initiator 509*c* may also have a bore shape that may provide a solid cone-shaped spray as depicted in FIG. 6B. Initiator 509*d* may have a bore shape that may provide a hollow cone-shaped spray, as depicted in FIG. 6C. A spray pattern of initiators 509*a*, 509*b*, 509*c*, and 509*d* may make a full perimeter contact with an inner surface of a tubular core. Full perimeter contact may provide a water seal within a siphon flush valve and assist in initiating a siphon effect and a flush.

Figure 7B:
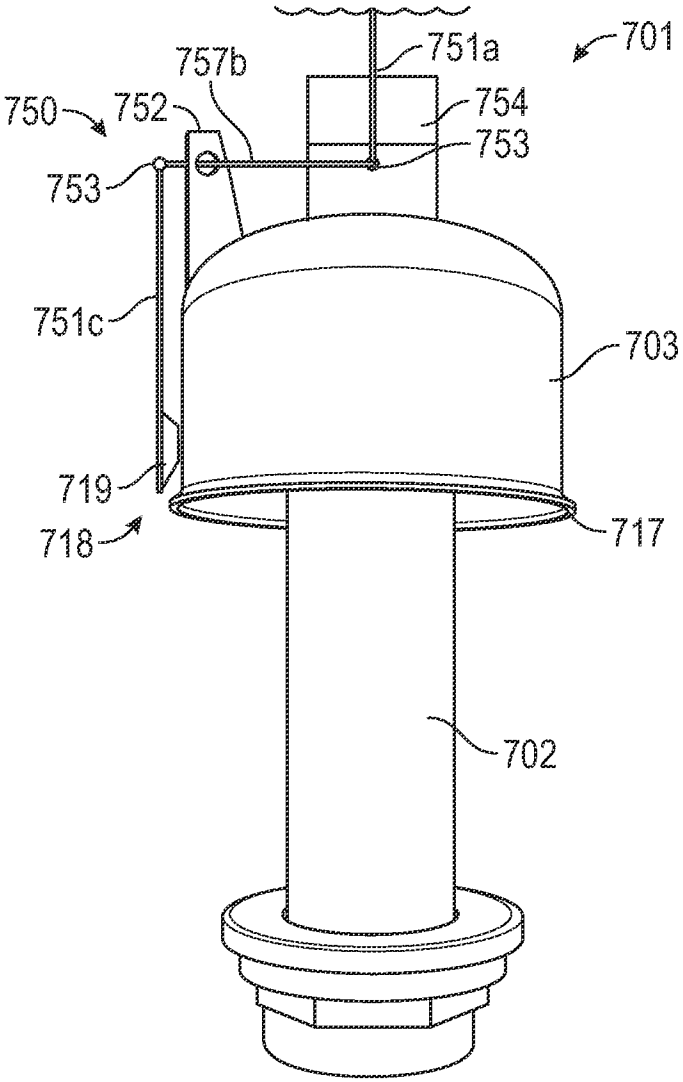
FIG. 7A and FIG. 7B show views of a siphon valve assembly having a mechanism to open and close a gate to provide multiple flush volumes, according to some embodiments.
Figure 7A:
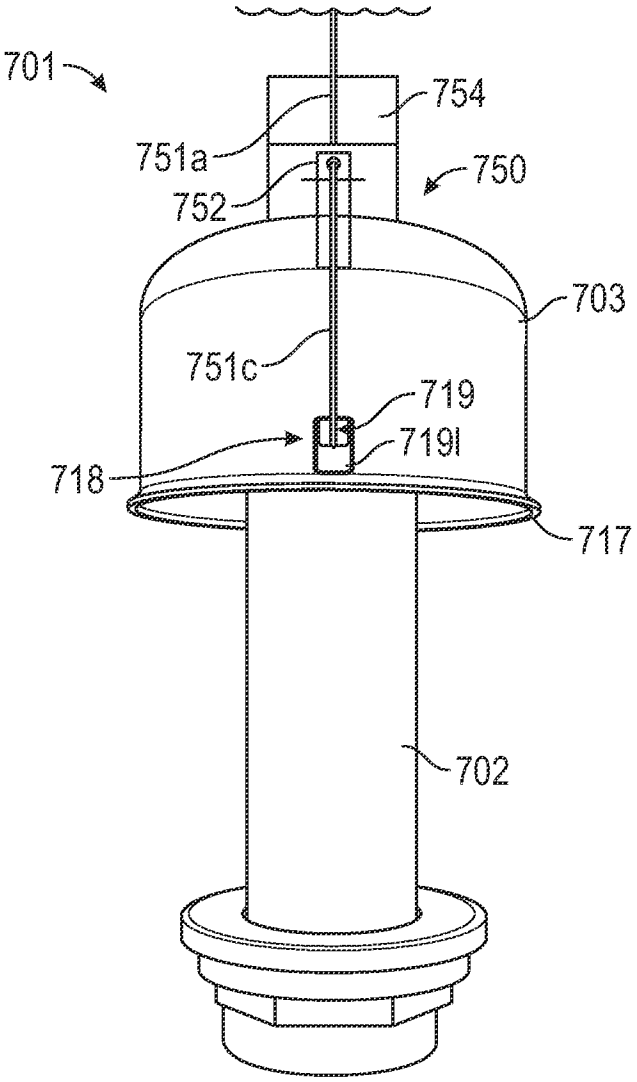

FIG. 7A and FIG. 7B provide front and side views of siphon valve assembly 701, respectively, according to some embodiments. Head 703 is positioned about tubular core 702, and comprises opening 718. Gate 719 is configured to slide vertically relative to opening 718. In FIG. 7A, gate 719 is shown in a lifted, open position, allowing access to opening 718. In FIG. 7B, gate 719 is shown in a lowered, closed position, dis-allowing access to opening 718. Assembly 701 comprises lift mechanism 750, configured to move gate 719 relative to opening 718 in order to open and close it. Lift mechanism 750 comprises a multi-arm linkage comprising arms 751*a*, 751*b*, and 751*c*, coupled by pin/hole connections 753. The multi-arm linkage is also supported by brackets 752 and 754. Arm 751*a* may be connected to an electric motor or a solenoid, which in turn is electrically connected to a controller. Arm 751*b* is supported by bracket 752, and arm 751*c* is configured to lift and lower gate 719 upon an instruction from the controller.

Upon receiving an instruction for a low volume flush, the controller is configured to instruct an electric motor or solenoid to push arm 751*a* downward to lift arm 751*c* to lift gate 719 (or to keep gate 719 in a lifted, open position). Upon receiving an instruction for a high volume flush, the controller is configured to instruct an electric motor or solenoid to lift arm 751*a* upward to push arm 751*c* downward to close gate 719 (or to keep gate 719 in a lowered, closed position). When gate 719 is in a lowered, closed position over opening 718, air will enter a siphon flow to break the siphon when tank water drops to head lower end 717, providing a high volume flush. When gate 719 is in a lifted, open position over opening 718, air will enter a siphon flow to break the siphon when tank water drops to gate lower end 7191, providing a low volume flush.

Figure 8B:
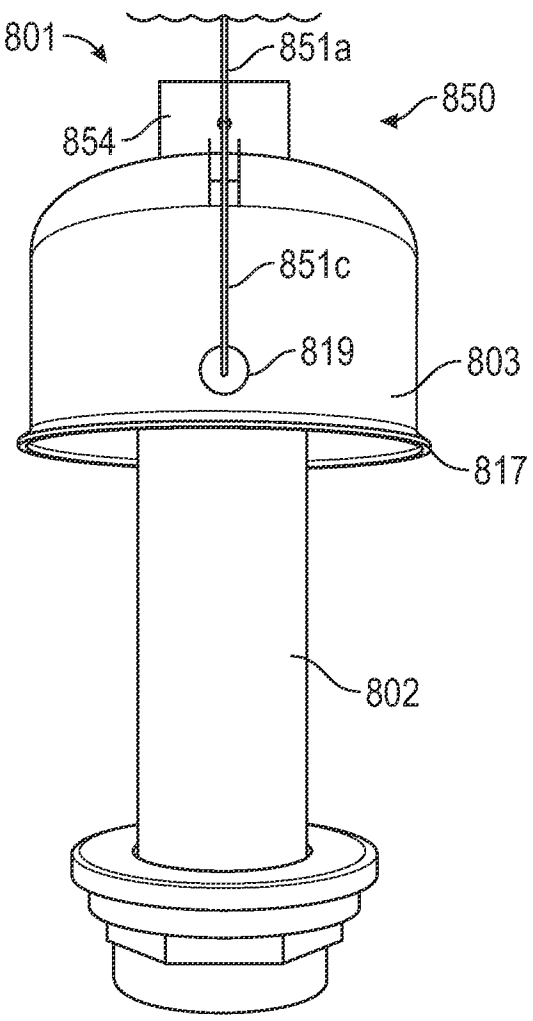
FIG. 8A and FIG. 8B provide views of a siphon valve assembly having a mechanism to open and close a gate to provide multiple flush volumes, according to some embodiments.
Figure 8A:
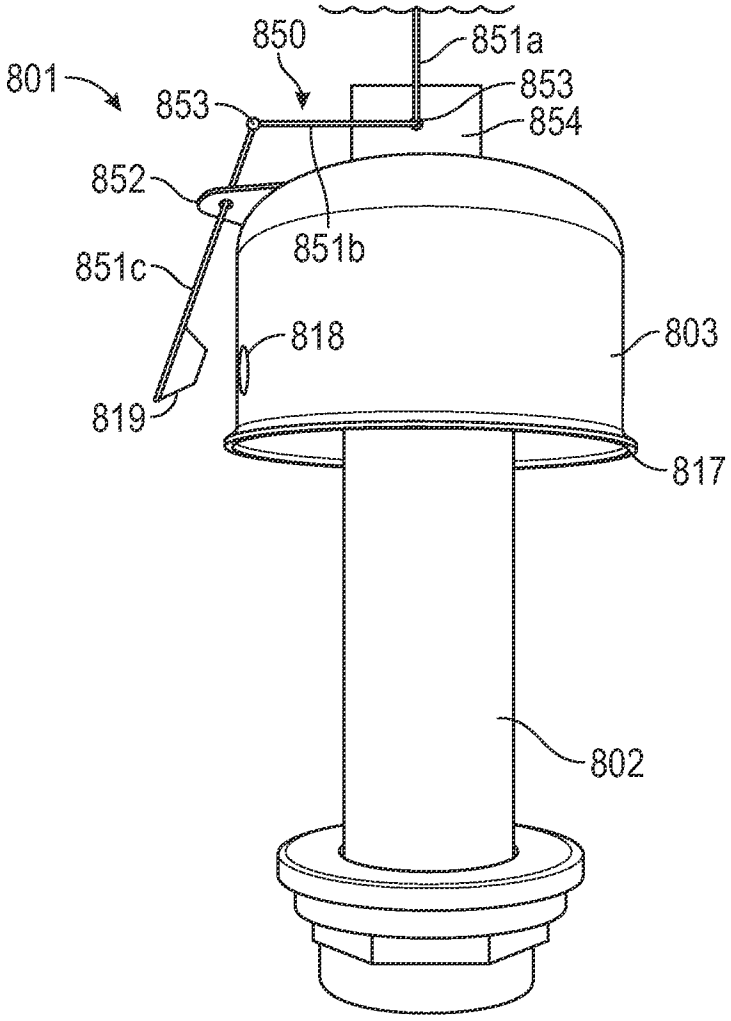

FIG. 8A and FIG. 8B show side and front views of siphon valve assembly 801, respectively, according to some embodiments. Siphon valve head 803 is positioned about tubular core 802, and comprises circular-shaped opening 818. Gate 819 comprises a "stopper-like" shape, and is configured to move laterally away from and towards opening 818. In FIG. 8A, gate 819 is shown in a "moved-outward", open position, allowing access to opening 818. In FIG. 8B, gate 819 is shown in a "moved-inward", closed position, dis-allowing access to opening 818. Assembly 801 comprises lift mechanism 850, configured to move gate 819 relative to opening 818 in order to open and close it. Lift mechanism 850 comprises a multi-arm linkage comprising arms 851*a*, 851*b*, and 851*c*, coupled by pin-hole connections 853. The multi-arm linkage is also supported by brackets 852 and 854. Arm 851*a* may be connected to an electric motor or a solenoid, which in turn is electrically connected to a controller. Arm 851*b* is supported by bracket 852, and arm 851*c* is configured to move gate 819 laterally upon an instruction from the controller.

Upon receiving an instruction for a low volume flush, the controller is configured to instruct an electric motor or solenoid to push arm 851*a* downward to move arm 851*c* to move gate 819 outward (or to keep gate 819 in a moved-outward, open position). Upon receiving an instruction for a high volume flush, the controller is configured to instruct an electric motor or solenoid to lift arm 851*a* upward to push arm 851*c* inward to close gate 819 (or to keep gate 819 in a moved-inward, closed position). When gate 819 is in an inward, closed position over opening 818, air will enter a siphon flow to break the siphon when tank water drops to head lower end 817, providing a high volume flush. When gate 819 is in an outward, open position over opening 818, air will enter a siphon flow to break the siphon when tank water drops to opening 818, providing a low volume flush.

Siphon flush valves of the disclosure are described in U.S. app. No. PCT/US19/37884, filed Jun. 19, 2019 (WO2020005660), the contents of which are hereby incorporated by reference.

In some embodiments, a capacitive sensor is configured to detect a user gesture, and to indicate detection of a gesture to a controller, whereupon the controller is configured send instructions to a solenoid valve to open to initiate a flush cycle. In some embodiments, a gesture may comprise an up or down hand or arm movement, or may comprise a forward or backward hand or arm movement.

In some embodiments, a capacitive sensor is configured to detect a user first gesture, wherein the first gesture is to indicate a desired low flush. In an embodiment, a user first gesture will result in a controller configured to send instructions do a flush valve head gate to open, and to send instructions to a solenoid to open to initiate a flush cycle.

In some embodiments, a capacitive sensor is configured to detect a user second gesture, wherein the second gesture is to indicate a desired full flush. In an embodiment, a user second gesture will result in a controller configured to send instructions to a flush valve head gate to close, and to send instructions to a solenoid to open to initiate a flush cycle.

In some embodiments, a capacitive sensor may be configured to detect a user third gesture, and to indicate detection of a third gesture to a controller, whereupon the controller is configured to not send "open" instructions to a solenoid valve for a defined programmable period of time so that the solenoid remains closed for the period of time. The third gesture may be for a period of time to clean a tank outer surface. That is to say, a third gesture may instruct the system to enter a cleaning cycle wherein the solenoid will not open.

In some embodiments, a first gesture, a second gesture, and a third gesture, may be different gestures, for example a hand swipe up and down, a hand motion towards and away, and a horizontal hand swipe. In some embodiments, first, second, or third gesture may comprise a same gesture, but repeated one or more times.

In other embodiments, detection of a third gesture may result in an indefinite amount of time where a solenoid is instructed to remain closed. In some embodiments, once a cleaning cycle is entered, a flush may be performed and a cleaning cycle exited by a user performing a first or a second gesture.

In an embodiment, an ultrasonic sensor may be a piezo ultrasonic transducer, for instance a piezo-ceramic transducer. In some embodiments, an ultrasonic sensor may be coupled to an interior or an exterior of a bowl to receive liquid or solid waste. An ultrasonic sensor may be configured to emit ultrasonic signals through water contained in a bowl, and receive ultrasonic signals reflected back. In some instances, ultrasonic signals are reflected back to a sensor from an unobstructed water surface (water seal surface). A water surface obstructed by solids may scatter or absorb signals, such that they are not reflected back to a sensor. A controller, having collected the information from an ultrasonic sensor, may determine a time-of-flight (ToF) of the signal or signals. A controller may compare a measured ToF to a standard ToF to determine bowl contents (bowl status), liquid or solid. Accordingly, a controller may then instruct a siphon valve to initiate a low volume flush or a high volume flush.

In some embodiments, an ultrasonic sensor may be in a "sleep" mode, that is, not emitting or receiving signals and/or communicating the signals to a controller. In some embodiments, a sleep mode may include periodic (regular or irregular intervals) "waking", where a sensor will emit and receive signals to check for proper water seal level and/or object/solids presence. For instance, a case of infrequent use, if it is determined that a water seal has partially or completely evaporated, a controller may instruct initiation of one or more flush cycles to re-fill the bowl.

In some embodiments, an ultrasonic sensor may be placed on a toilet bowl exterior underside, in some embodiments, directly beneath and substantially centered relative to a water seal. In some embodiments, with a toilet bowl having a trapway inlet and jet outlet in a sump area, an ultrasonic sensor may be positioned on a bowl underside and substantially centered between a trapway inlet and jet outlet in x-y directions.

In some embodiments, a method of coupling an ultrasonic sensor to a bowl may include machining a bowl surface to remove a glaze. In some embodiments, an adhesive, comprising one or more different adhesives, may be employed to affix an ultrasonic sensor to a sanitaryware device. In some embodiments, a sanitaryware fixture may include a pocket or recess configured to receive an ultrasonic sensor. A thickness of a sanitaryware fixture may be somewhat thinner in a recess area to facilitate ultrasonic signal transmission. In some embodiments, an adhesive includes a 2-part methylmethacrylate adhesive. In other embodiments, an adhesive includes an alkylcyanoacrylate ester adhesive. In certain embodiments, certain parts of an ultrasonic sensor are affixed with a 2-part methylmethacrylate adhesive, and other distinct parts are affixed with an alkylcyanoacrylate ester adhesive. In some embodiments, an ultrasonic sensor is electrically coupled to a controller via a wire, wherein the wire runs from underneath a bowl and behind a tank assembly to a controller in a housing positioned in the tank.

In some embodiments, a capacitive sensor and/or a housing may be affixed to a tank inner wall with one or more adhesives as discussed above.

In some embodiments, a capacitive sensor may be configured to receive a user gesture to indicate a bowl flush is desired. An ultrasonic sensor may be configured to determine if bowl contents are solid or liquid, and to indicate to the controller if a high volume flush or a low volume flush is appropriate, respectively.

According to an embodiment, a siphon flush valve for a toilet may include a tubular core configured to couple to a toilet tank opening; a head coupled to a top of the core, the head having a head opening; a spray initiator coupled to the head opening; a siphon flush valve inlet; and a siphon flush valve outlet. A spray initiator may be configured to induce a siphon flow of a surrounding fluid, through the siphon flush valve inlet, and exiting through the siphon flush valve outlet. In some embodiments, a surrounding fluid may be in a toilet tank, wherein a starting (standing) water level between flush cycles will be above a siphon valve inlet defined by a lower end of the head.

A head may be a substantially cylindrical cap located around (about) the core. In some embodiments, the head may be a substantially cylindrical cap located substantially concentrically around the core. A head opening may be located in a center of a substantially cylindrical cap and wherein the initiator extends downward from the opening into the core.

In some embodiments, the core may include weir located at an upper surface or edge of the core. In some embodiments, a core may be substantially tubular. A core may comprise a substantially hollow cylinder-like tube having open top and bottom ends. "Tubular" may mean tube-like (shaped like a tube). In some embodiments, a core may include a first substantially tubular section, a tapered section, and a second substantially tubular section. In some embodiments, an upper portion of a tubular core curves outward at the weir; and optionally extends longitudinally downward from the weir. In some embodiments, an upper section curves outward at the weir and extends longitudinally downward parallel to an outer surface of the tubular core. In other embodiments, a tubular core curves inward at the weir; and optionally extends longitudinally downward from the weir.

In some embodiments, a tubular core comprises an inner wall surface and an outer wall surface, wherein a fluid spray initiator is configured to spray pressurized fluid on an entire perimeter of the inner wall surface to form a fluid seal, thereby creating negative pressure in the tubular core and initiating a siphon flow to initiate a flush.

A siphon flush valve may include a flow path defined between an inner surface of the head and an outer surface of the core. In some embodiments, the initiator may include a bore having a substantially constant diameter. In some embodiments, the initiator may comprise a tapered bore. In some embodiment, a spray initiator may have a constant diameter bore section and a tapered section. In some embodiments, the initiator may have a bore tapered outwardly (downward) in a cone shape. A tapered bore may be configured to provide a shaped fluid spray. A siphon flush valve inlet may be located at a lower end of the head and the siphon flush valve outlet is located at a lower end of the core. A siphon flush valve may include an internal cavity, wherein the siphon flush valve inlet is configured such that the internal cavity has a first pressure when at a tank starting water level and a second pressure when at a tank ending water level.

In some embodiments, a surrounding fluid may have a starting level at a point above the siphon flush valve inlet and an ending level at a point at or below the siphon flush valve inlet. The terms "starting" and "ending" meaning prior to and at the end of a siphon flush (flush cycle). A siphon flush may end when a fluid level reaches a flush valve inlet and air enters the valve, breaking the siphon. A surrounding fluid surrounds the siphon flush valve, for instance as in a toilet tank.

An initiator may be a spray initiator. A spray initiator may be a pressurized spray initiator. A siphon flush valve inlet may be positioned with a first configuration below a tank starting water level and a second configuration above a tank ending water level. A head and the core may be longitudinally axially aligned.

A siphon flush valve may be "flapperless". A siphon flush valve inlet may be located circumferentially around the core. A head may be a dome (dome-shaped) and wherein the dome is wider than the core to define the siphon flush valve inlet. An initiator may be configured to discharge a pressurized fluid into the core in a cone-shaped spray. In other embodiments, an initiator may be configured to discharge pressurized fluid into the tubular core in a square or pyramid-shaped spray.

An initiator may be configured to create a pressure differential between a bore of the tubular core (the core bore) and a toilet tank. A head may be located around the tubular core such that the siphon flush valve inlet and a flow path are formed between the head and the core. In some embodiments, the head may be located substantially concentrically around the core. A siphon flush valve may be configured without moving parts.

According to an embodiment, a siphonic flush valve system for a toilet may include a siphon flush valve, the siphon flush valve having a core coupled to a toilet tank opening, a head having a head opening and attached at a top of the core, and an initiator coupled to the head opening, a siphon flush valve fluid supply line coupled to the initiator; a solenoid valve coupled to the siphon flush valve fluid supply line; and a controller configured to open the solenoid valve to initiate a flow of pressurized fluid in the siphon flush valve fluid supply line. An initiator may be configured to supply a flow of pressurized fluid to the core to initiate a siphon flow of a surrounding fluid in a toilet tank, through the siphon flush valve, and into a toilet bowl.

An initiator may be configured to discharge flow of pressurized fluid to the core in a cone-shaped spray. An initiator may be configured to create a pressure differential between the tubular core and the toilet tank. A siphonic flush valve system may include a flow path from a siphon flush valve inlet and a siphon flush valve outlet and wherein the siphon flow flows through the flow path. A flow path may extend from the siphon flush valve inlet, through a space between the core and the head, over a weir on the core, though a bore of the core, and to the siphon flush valve outlet.

A head may be located around the core such that a siphon flush valve inlet and a flow path are formed between the head and the core. A tubular core may include a weir and a down leg portion and wherein the initiator extends into the down leg portion. A siphon flush valve may be configured to empty fluid in the toilet tank from a starting water level adjacent the weir to an ending water level adjacent a siphon flush valve inlet.

In some embodiments, a controller is in electronic communication with a solenoid valve and configured to open and close the solenoid valve. Electronic communication may be wired or wireless. In some embodiments, a controller and a solenoid may be associated with a battery and/or another power source.

In some embodiments, a control assembly comprises a capacitive sensor, a controller, and a power source. A power source may include one or more batteries. In some embodiments, a solenoid valve may be in electrical communication with a controller (microcontroller or printed circuit board) and in electrical communication with a capacitive sensor. A control assembly may be configured to actuate a solenoid valve upon detecting a gesture of a user, for example upon detecting a first or a second gesture. In some embodiments, a control assembly may comprise an ultrasonic sensor configured to determine bowl contents. An ultrasonic sensor may also be in electrical communication with the controller.

In certain embodiments, a solenoid valve may be configured to close after a certain amount of time has elapsed after being opened. In some embodiments, a period of time may extend beyond a "siphon break" to provide fluid to refill a toilet bowl to provide a bowl seal. In some embodiments, a solenoid valve may be associated with a timer or clock. In some embodiments a controller associated with a solenoid valve may comprise a timer function and configured to open a solenoid valve and to close the solenoid valve after a certain amount of time has elapsed.

A siphon flush valve may be flapperless. A siphon flush valve may have no moving parts. A controller may be configured to close a solenoid valve to terminate flow of pressurized fluid in the siphon flush valve fluid supply line.

According to an embodiment, a siphonic flush valve may include a flush valve body; a flush valve bore within the flush valve body; and a spray initiator in fluid communication with the flush valve bore. A spray initiator may be configured to discharge a pressurized fluid in contact with an entire perimeter of the flush valve bore to create a fluid seal within the flush valve bore thus initiating a siphon flow within the flush valve.

A spray initiator may be configured to create a negative pressure differential in the flush valve bore to initiate the siphon flow. A spray initiator may be configured to discharge the pressurized fluid in a full cone-shaped spray, hollow cone-shaped spray, or square cone-shaped spray, among other shapes.

According to an embodiment, a method for initiating fluid flow in a flush valve of a toilet assembly may include discharging a pressurized fluid from a spray initiator in a flush valve; contacting an entire perimeter of a bore of the flush valve with the pressurized fluid; creating a fluid seal within the bore; creating a negative pressure differential in the bore; initiating a siphon flow in the flush valve; and discharging fluid from a toilet tank to a toilet bowl with the siphon flow.

A spray initiator may be a sprayer, spray initiator, and/or a nozzle. A spray initiator may be secured within a head opening via adhesion, friction fit, press fit, threads, glue, overmolding, screw threads, bayonet threads, or other types. A spray initiator may be formed as a unitary, single body or may be formed from a plurality of parts coupled together. An initiator may have a substantially cylindrical outer surface with a bore therethrough. An initiator may be tubular in shape. An initiator may have a flange configured to secure to a lower surface of a head. A toilet may be a gravity-fed toilet, a wall hung toilet, a one-piece toilet, a two-piece toilet, etc.

A tubular core may have a choke point at a transition from a first substantially tubular section to a tapered section. A choke point may be configured to improve flow dynamics and efficiencies. A choke point may improve flow dynamics and efficiencies, for example, due to a divergence of a tubular core bore. A divergence of a core bore may be caused by the diameter of bore tapering inwardly and subsequently tapering outwardly. A divergence of a bore may be where a bore extends (or alternatively tapers inwardly) from a first diameter at a top of first substantially tubular section to a choke point and subsequently tapers outwardly during a tapered section to an inner diameter of a second substantially tubular section. A divergence of a bore may increase the velocity or speed of a fluid flowing through a siphon flush valve as compared to a straight bore. An increased velocity of a fluid flow may increase the rate of discharge of fluid from a toilet tank to a toilet bowl, thus enhancing efficiency and performance of a toilet. A core may be substantially tubular. A first substantially tubular section, a tapered section, and a second substantially tubular section may be coupled or integrally formed.

A tapered section may taper outwardly from a first diameter $D_1$ of a first substantially tubular section to a second diameter $D_2$ of a second substantially tubular section. A second diameter $D_2$ may be larger than first diameter $D_1$. A tapered section may taper both internally (e.g. the bore of a tapered section may taper outward) and externally (e.g. the outer surface of a tapered section may taper outward). A core may include a flange extending outwardly from an outer surface of a tubular core. A flange may be located at a lower end of a tapered section and/or at an upper end of a second substantially tubular section. A flange may align a siphon flush valve with a tank opening and maintain a siphon flush valve therein. Enhanced flow, as previously described, may be achieved from a first substantially tubular section and a tapered section due to the expanding bore diameter. An enhanced flow may be divergent flow where under full flow conditions, flow transitions from a choke point gradually diverging outward. This may create flow separation thus increasing a flow velocity through a choke point. A change in diameter may benefit or aid in establishing siphon flow during an initial or transient phase (e.g. during initiation of a siphon flow in a siphon flush valve). Various configurations may be contemplated in accordance with the invention to increase flow velocity and volume. This may also reduce the amount of time and/or flow needed to establish a siphon flow.

A siphon flush valve inlet and a fluid flow path may be substantially annular. A flow path may be defined between an inner surface of a head and an outer surface of a tubular core. A flow path may be defined from a structure of a head and a tubular core, embodiments of which are described herein. A siphon flush valve may have an internal cavity defined by a tubular bore and a flow path. A siphon flush valve may have a longitudinal axis L. A head, initiator, and/or core may be aligned along the longitudinal axis L. A head and core may be concentric about the longitudinal axis L. Where head and core are not circular in cross-section, head and core may still be aligned with center points along the longitudinal axis. A head may be wider and/or have a larger diameter than a tubular core such that siphon flush valve inlet and/or a flow path is defined therebetween. An area defined by a space between a siphon flush valve inlet and an upper portion of a core may be greater than or equal to the area defined by a space between a head apex and a weir. A space between a head apex and a weir may be greater than or equal to the area defined by a top of bore. An initiator may be located such that a spray pattern emitted from initiator contacts the bore at or lower than a weir.

A starting surrounding water level may be at a higher vertical position than a siphon flush valve inlet. A starting water level may be higher than a siphon flush valve inlet to ensure no air exists at a siphon flush valve inlet (e.g. a water seal is present) and to ensure a siphon may be initiated when a flush cycle is started. A starting water level may be at or near the top of a weir. A water level lower than the top of a weir may require a greater pressure differential to initiate siphon flow. A water level higher than the top of a weir may provide for water to spill over and provide a "run on" condition. Surrounding water in a toilet tank which at a starting water level may be water at atmospheric pressure. In an initial condition, pressurized water may be supplied through a siphon flush valve fluid supply line. Water may be pressurized water and may be admitted through a solenoid valve that is opened via instructions from a controller. Water may exit a siphon flush valve fluid supply line and discharge into a bore through a spray initiator. Water may exit a spray initiator in a cone pattern. Cone pattern may be substantially cone-shaped, such as, a full cone, a hollow cone, or a square cone shape. A tapered portion of a bore of an initiator may be configured for water to exit an initiator in a cone pattern. That is, since a tapered portion of a bore may have a conical shape, water which exits this portion may also take on a conical shape. Discharge of water in a cone pattern into a tubular bore may create a negative pressure differential. A pressure differential may be such that the pressure within a siphon flush valve is lower than the pressure in a toilet tank. A starting surrounding water level in a toilet tank may have an initial condition at atmospheric pressure. Water that flows out of an initiator may be at a higher pressure than the atmospheric pressure of starting surrounding water level. This may create a reduced pressure at a weir and flush valve inlet. A reduced pressure within siphon flush valve induces a siphon effect, pulling water from starting surrounding water into a siphon flush valve inlet, through a flow path, over a weir, into a tubular bore and out a siphon flush valve outlet.

Once a siphon effect has been initiated, pressurized water from a siphon flush valve fluid supply line may be stopped. Pressurized water may be stopped by closing a solenoid valve. So long as no air is provided to an interior of a siphon flush valve, water may continue to empty from a toilet tank to a toilet bowl for flushing of a toilet. As water approaches an ending water level, the water level may no longer completely cover a siphon flush valve inlet. Accordingly, air may be permitted to enter siphon flush valve inlet and become entrained with flow of water through the siphon flush valve. With air entering the siphon flush valve inlet, the siphon effect through siphon flush valve is broken and a flush is stopped.

A height of starting surrounding water level and a height of ending surrounding water level may be selected such that the volume therebetween effectively flushes a toilet. A height between starting surrounding water level and ending surrounding water level may be optimized for a predetermined discharge volume. A fill valve may be controlled to refill a toilet tank to the starting water level. A siphon flush valve inlet may be placed at a height corresponding to a desired ending water level. A system thus may be configured for a fixed flush volume discharge.

Various parameters may be customized or altered in the operation of a toilet and/or siphon flush valve. Such parameters include dimensions and parameters (e.g. diameters, lengths, shape, orientation, etc.) of a siphon flush valve, height of the weir, fluid pressure from the main plumbing source, fluid pressure in a siphon flush valve fluid supply line, dimensions and parameters (e.g. diameters, lengths, shape, orientation, etc.) of the initiator, size and orientation of a siphon flush valve inlet, duration of the initiator discharging fluid, activation time of a solenoid, and/or initiator, etc. In an exemplary embodiment, a siphon flush valve with the previously described parameters, may have the following parameters to achieve a siphon flush effect to discharge fluid from a toilet tank to a toilet bowl. A solenoid may be open for about 2.5 seconds at about 40 psi and above to initiate siphon flow. Refilling or resealing of a toilet bowl may be achieved by increasing a duration ("ON" time) to dispense additional water for this purpose. Refilling or resealing may be an amount of water needed to refill a toilet bowl to a level to provide a water seal to prevent sewer gasses from traveling through a trapway and up through a bowl. A controller, solenoid, and initiator may be dual purpose in function; one, to initiate siphon action, and two, to refill a water seal in a toilet bowl after a flush cycle, if the timing is configured to allow this added function. A divergent flow pattern may be used to form a seal between a nozzle and a valve core inside diameter perimeter. Another seal may be created by a starting water level which is at or near a weir height. As water is flowing through a sprayer contacting a core inner perimeter wall and flowing downward, it creates a negative pressure or vacuum to cause atmospheric pressure acting on a free surface to push cistern water up and over the weir and thusly establishing gravity siphon flow. Other flow patterns are contemplated. For example, if, a straight flow column were large enough to contact a core inner perimeter wall, it may generate siphon flow.

A head may have an outer surface having a substantially cylindrical or tubular shape. An outer surface may curve radially outward at a lower end. A lower end may create a concave surface in an outer surface. A lower end may be radiused or profiled to improve flow dynamics and efficiencies. A radiused or profiled lower end may improve flow dynamics by reducing energy losses. An outer surface may extend longitudinally upward from a lower end to an upper end. At an upper end, an outer surface may curve at a curved portion upward from an outer end to an apex and then downward toward a head opening. A head opening may have a substantially cylindrical shape. In a lateral view, a head may appear "donut" shaped.

A siphon flush valve may taper outwardly at the top. A full round feature may form an effective siphon with sprayer technology alone. An outward taper profile, under dynamic flow conditions, at an initial or transient flow stage (air and water) may follow the profile shape, first spilling over at the weir, secondly following the taper downward and thirdly, following vertically downward. As flow, for example, the flow velocity, increases, the flow will separate from the boundary wall at the taper to the vertically downward transition resulting in convergent flow stream toward a center of the valve. As the valve is of substantially circular design in cross-section, the resulting annular flow will meet in the bore of a siphon flush valve and effectuate a seal to allow a pressure differential to form as water flows downward through a bore of a siphon flush valve (e.g. through the down leg portion), thus aiding a siphon effect to develop in the siphon flush valve. A previously described action, combined with a previously mentioned initiator, may be configured for a siphon to form and transition to full siphon (no air) more quickly than a full round weir feature. Other profile shapes may be provided for improving efficiencies.

An upper portion of a tubular core may have an outwardly and downwardly extending shape. An upper portion may include a wall which extends and/or curves from weir outward and downward to a lower surface. A lower surface may be curved or turned inward toward the core from the wall. A weir may be a profiled or radiused throat to provide a flow path with improved flow dynamics and efficiencies. An upper portion may form a gap between an exterior surface of a core and a wall of an upper portion. A gap may be substantially annular. A weir may align with a center of a curved portion of a head. In this manner, when assembled, a head and an upper portion of a core may be substantially concentric. A relationship between a head and an upper portion may provide a siphon flush valve inlet and a flow path for water to flow from an exterior of a siphon flush valve through a tubular bore. A siphon flush valve inlet and flow path may be annular. An outward curve of a lower surface of a core and an outward curve of a lower end of a head may provide an enlarged siphon flush valve inlet. This may improve flow dynamics and efficiencies.

In some embodiments, a head and tubular core may have shapes other than cylindrical, for instance ovular. A width of a head and a core may be smaller than a length of the head and the core. An oval or elliptical shape of a siphon flush valve may allow siphon flush valve to be accommodated in more toilet tanks as toilet tanks are generally more wide than deep. Although a circular and elliptical siphon flush valve are described, a siphon flush valve may be other shapes.

Although siphon flush valves of the present disclosure are depicted and described as substantially concentrically arranged siphon flush valves, other shapes and arrangements are possible. A substantially concentric siphon flush valve may allow for uniform flow from the tank into a siphon flush valve. Uniform flow may improve the efficiency and rate of flow in a siphon flush valve. Other contemplated shapes and arrangements (e.g. non-concentric arrangements) may also exhibit uniform flow from the tank into a siphon flush valve.

A toilet system may include a control assembly. A control assembly may be coupled to a toilet tank. A control assembly may be coupled to an interior of the toilet tank within a water proof compartment or housing. In some embodiments, a control assembly may be coupled to a bowl or tank exterior.

A control assembly may include one or more of a capacitive sensor, a battery, wiring, or a printed circuit board controller (controller). A control assembly may be associated with solenoid valve. A solenoid valve is controllable between an open position and a closed position. In an open position, a solenoid valve may admit fluid from a first siphon flush valve supply line to a second siphon flush valve supply line. A second siphon flush valve supply line may be the same as a siphon flush valve fluid supply line previously described. A second siphon flush valve supply line may supply water to an initiator. In a closed position, a valve may prevent flow between a second siphon flush valve supply line and a first siphon flush valve supply line. A printed circuit board may send and receive signals from a capacitive sensor to and from a solenoid. A battery may be a battery pack and may supply power to the various electric components.

In some embodiments, a control assembly may comprise an ultrasonic sensor. An ultrasonic sensor may be positioned on a toilet bowl underside and configured to determine bowl contents. In some embodiments, a control assembly may also include a mechanism configured to open and close a gate positioned in an opening on a siphon valve head.

In some embodiments, a mechanism configured to open and close a gate positioned in an opening on a siphon valve head may comprise an electric motor, a hydraulic piston assembly, a solenoid, etc. A mechanism may be positioned at or near a gate, or may be positioned away from a gate, and may include a wire or hydraulic feature configured to open and close the gate. A mechanism may include a gear assembly and may include a multi-arm linkage assembly.

In some embodiments, an ultrasonic sensor may communicate to a controller if bowl contents comprise solid or liquid waste. Upon a user providing a gesture near a capacitive sensor in order to perform a flush, the capacitive sensor will communicate this to a controller. The controller may already have received a communication from an ultrasonic sensor as to the bowl contents. The controller may then instruct a gate positioned in an opening in a siphon valve head to open or close (or remain open or remain closed) and then to instruct the solenoid to open to initiate a flush. If it is determined the bowl comprises liquid contents, the gate will be instructed to be in an open position, and a low volume flush will be performed If it is determined the bowl comprises solid contents, the gate will be instructed to be in a closed position, and a high volume flush will be performed.

A tee may allow a water source for an initiator to be tapped prior to a fill valve. A pressure for an initiator may be determined by a building infrastructure, typically between about 20 psi and about 120 psi. A lower pressure may equate to a lower spray volume and lower pressure generation in a siphon flush valve, thus resulting in a lower efficiency siphon flush valve. Initiators of the present disclose may form a pattern, annular in form, from the center of an initiator head diverging toward and making contact with the bore of the core.

In some embodiments, a present system may comprise a vacuum breaker, which may be required to allow a flush valve to be code compliant. A vacuum breaker may be positioned upstream (prior to) a spray initiator.

Divergent spray angles ranging from about 50 degrees to about 120 degrees may be provided. A spray pattern may be solid or hollow in form and may be cone, square, pyramid, or oval, etc. in shape. Initiators may be singular or plurality part construction. An initiator may be fixed permanently or made for ease of removal for maintenance. An initiator may be fixed by overmolding, glue, interference fit, screw, or bayonet thread. In some embodiments, a connection between an initiator and a siphon flush valve head may be sealed, e.g., leak-free.

Siphon flush valves of the present disclosure allow for a flapperless flush system. Siphon flush valves of the present disclosure allow for a system which does not leak due to worn, chemically degraded, damaged, etc. flapper seals. Siphon flush valves of the present disclosure allow for a flush valve with no moving parts, reducing the likelihood of damage, failure, and/or need for repair. A concentric design of the head with respect to the core allows for higher flow throughput in a compact structure.

Siphon flush valves of the present disclosure may be combined with a bidet. Siphon flush valves of the present disclosure may work with one-piece and two-piece toilets having a water tank reservoir. For a one-piece toilet, a siphon flush valve may have a base fixation type that may differ from the two-piece toilet (e.g. the threaded spud with nut). Siphon flush valves of the present disclose may be provided to a toilet having a remote tank or cistern. For example, a tank or cistern hidden in a wall. In this example, additional water conduits may be needed.

A toilet bowl comprises a rim extending at least partially around an upper perimeter of the bowl, an interior surface, and a sump area. In some embodiments, a rim may define a rim channel extending from a rim inlet port and around an upper perimeter of the bowl and having at least one rim outlet port in fluid communication with an interior surface of the bowl. Fluid flow through a rim channel may serve to clean the bowl. In an embodiment, a bowl may have a rim shelf extending transversely along an interior surface of the bowl from a rim inlet port at least partially around the bowl so that fluid is configured to travel along the rim shelf and enter the bowl interior in at least one location displaced from the rim inlet port.

A bowl sump area is in fluid communication with a trapway inlet. A bowl sump area may define a sump trap. In some embodiments, a portion of an interior wall of the bowl in the sump area may be configured to upwardly incline from a jet outlet port toward the trapway inlet.

The sump area of the bowl in one embodiment has a sump trap defined by the interior surface of the bowl and having an inlet end and an outlet end, wherein the inlet end of the sump trap receives fluid from the jet outlet port and/or the interior area of the bowl and the outlet end of the sump trap is in fluid communication with the trapway inlet; and wherein the sump trap has a seal depth. An upper surface or uppermost point of the jet outlet port may be within the sump trap and positioned at a seal depth below an upper surface of the inlet to the trapway as measured longitudinally through the sump area. In some embodiments, a sump trap seal depth may be from any of about 1 cm, about 2 cm, about 3 cm, about 4 cm or about 5 cm to any of about 6 cm, about 7 cm, about 8 cm, about 9 cm, about 10 cm, about 11 cm, about 12 cm, about 13 cm, about 14 cm or about 15 cm or more.

In some embodiments, a toilet assembly may comprise a jet defining at least one jet channel, the jet channel extending from a jet inlet port in fluid communication with a flush valve to a jet outlet port positioned in a bowl sump area and configured for discharging fluid through the sump area to a trapway. In some embodiments, a jet channel, once primed with fluid, is capable of remaining primed before actuation of and after completion of a flush cycle. A trapway is in fluid communication with a sump area of a toilet bowl and with a waste outflow line.

Following are some non-limiting embodiments of the disclosure.

In a first embodiment, disclosed is a touchless toilet assembly comprising a toilet tank, the toilet tank comprising a control assembly; and a siphon valve assembly, wherein the control assembly comprises a capacitive sensor, a controller, and a power source, and the siphon valve assembly comprises a tubular core, a head coupled to and surrounding an upper end of the tubular core, a spray initiator positioned in the head and extending into the tubular core, and a solenoid valve fluidly coupled to the spray initiator, and wherein the power source is electrically connected to the capacitive sensor, the controller, and the solenoid valve, the capacitive sensor is configured to detect a first gesture, and to indicate detection of the first gesture to the controller to initiate a flush cycle, the controller, upon receiving indication of the first gesture from the capacitive sensor, is configured to instruct the solenoid valve to open, the spray initiator, upon opening of the solenoid valve, is configured to spray pressurized water on an entire perimeter of a tubular core inner surface to form a water seal, thereby creating negative pressure in the tubular core and initiating a siphon flow of surrounding water in the toilet tank.

In a second embodiment, disclosed is a touchless toilet assembly according to embodiment 1, wherein a lower end of the head defines a siphon valve inlet, a lower end of the tubular core defines a siphon valve outlet, the upper end of the tubular core defines a weir, and the negative pressure created in the tubular core initiates the siphon flow of the toilet tank water through the siphon valve inlet, over the weir, through the tubular core, and out the siphon valve outlet to a toilet bowl to perform a flush.

In a third embodiment, disclosed is a touchless toilet assembly according to embodiments 1 or 2, configured so that siphon flow of the toilet tank water continues until a surrounding water level drops to a lower end of the head and air enters the siphon valve inlet, thereby breaking the siphon flow.

In a fourth embodiment, disclosed is a touchless toilet assembly according to any of the preceding embodiments, wherein the solenoid valve is configured to close after a predetermined time interval. In a fifth embodiment, disclosed is a touchless toilet assembly according to any of the preceding embodiments, wherein the solenoid valve is configured to close after a predetermined time interval, wherein the predetermined time interval extends beyond breaking of the siphon flow to provide water for refilling a toilet bowl to form a sanitary water seal.

In a sixth embodiment, disclosed is a touchless toilet assembly according to any of the preceding embodiments, wherein the upper end of the tubular core defines a weir, and wherein the weir comprises an outward and downward extension of the tubular core. In a seventh embodiment, disclosed is a touchless toilet assembly according to any of embodiments 1 to 5, wherein the upper end of the tubular core defines a weir, and wherein the weir comprises an inward and downward extension of the tubular core.

In an eighth embodiment, disclosed is a touchless toilet assembly according to any of the preceding embodiments, wherein the head and the tubular core are symmetrically aligned and the siphon valve inlet is located circumferentially around the tubular core.

In a ninth embodiment, disclosed is a touchless toilet assembly according to any of the preceding embodiments, comprising a fill valve positioned in the toilet tank, wherein the fill valve is fluidly coupled to the solenoid valve via a first water supply line, and the solenoid valve is fluidly coupled to the spray initiator via second water supply line. In a tenth embodiment, disclosed is a touchless toilet assembly according to embodiment 9, wherein the first water supply line is coupled to the fill valve via a port positioned below (upstream of) a fill valve outlet configured to refill the toilet tank during a flush cycle.

In an eleventh embodiment, disclosed is a touchless toilet assembly according to any of the preceding embodiments, wherein detection of the first gesture results in the controller initiating a low volume flush cycle. In a twelfth embodiment, disclosed is a touchless toilet assembly according to any of the preceding embodiments, wherein the capacitive sensor is configured to detect a second gesture, wherein detection of the second gesture results in the controller initiating a high volume flush cycle.

In a thirteenth embodiment, disclosed is a touchless toilet assembly according to any of the preceding embodiments, wherein the siphon valve head comprises one or more gates, wherein the one or more gates in an open position provides for a low volume flush cycle, and wherein the one or more gates in a closed position provides for a high volume flush cycle. In a fourteenth embodiment, disclosed is a touchless toilet assembly according to embodiment 13, wherein the controller is electrically coupled to a mechanism configured to open and close the one or more gates.

In a fifteenth embodiment, disclosed is a touchless toilet assembly according to any of the preceding embodiments, wherein the control assembly comprises an ultrasonic sensor configured to be positioned on a toilet bowl, and wherein the controller is configured to receive information from the ultrasonic sensor and to determine bowl contents based on the information. In a sixteenth embodiment, disclosed is a touchless toilet assembly according to embodiment 15, wherein upon determination of liquid contents, the controller is configured to instruct a low volume flush cycle. In a seventeenth embodiment, disclosed is a touchless toilet assembly according to embodiment 15, wherein upon determination of solids contents, the controller is configured to instruct a high volume flush cycle.

In an eighteenth embodiment, disclosed is a touchless toilet assembly according to any of the preceding embodiments, wherein the capacitive sensor is configured to detect a third gesture, and to indicate detection of the third gesture to the controller to initiate a cleaning cycle, and the controller, upon receiving indication of the third gesture from the capacitive sensor, is configured to instruct the solenoid valve to remain closed for a predetermined period of time.

In a nineteenth embodiment, disclosed is a touchless toilet assembly according to any of the preceding embodiments, wherein the capacitive sensor is fixed to an interior wall of the toilet tank. In a twentieth embodiment, disclosed is a touchless toilet assembly according to any of the preceding embodiments, wherein the capacitive sensor is fixed to an interior wall of the toilet tank with an adhesive. In a twenty-first embodiment, disclosed is a touchless toilet assembly according to any of the preceding embodiments, wherein the capacitive sensor is fixed to an interior wall of the toilet tank with a two-part methylmethacrylate adhesive and/or an alkylcyanoacrylate ester adhesive. In a twenty-second embodiment, disclosed is a touchless toilet assembly according to any of the preceding embodiments, wherein an interior wall of the toilet tank comprises a recess to receive the capacitive sensor.

In a twenty-third embodiment, disclosed is a touchless toilet assembly according to any of the preceding embodiments, wherein the capacitive sensor is in wired electrical communication with the controller and the power source. In a twenty-fourth embodiment, disclosed is a touchless toilet assembly according to any of the preceding embodiments, wherein the controller is in wired electrical communication with the solenoid valve.

In a twenty-fifth embodiment, disclosed is a touchless toilet assembly according to any of embodiments 1 to 23, wherein the controller is in wireless electrical communication with the solenoid valve. In a twenty-sixth embodiment, disclosed is a touchless toilet assembly according to any of the preceding embodiments, wherein the power source comprises a battery.

In a twenty-seventh embodiment, disclosed is a touchless toilet assembly according to any of the preceding embodiments, wherein the head comprises a dome-shaped cap or a cylinder-shaped cap. In a twenty-eighth embodiment, disclosed is a touchless toilet assembly according to any of the preceding embodiments, wherein the head comprises a plurality of splines extending from an inner surface thereof, the splines configured to locate and hold the head in place on the tubular core upper end.

In a twenty-ninth embodiment, disclosed is a touchless toilet assembly according to any of the preceding embodiments, wherein the spray initiator is configured to discharge the pressurized water into the tubular core in a spray shaped to form the water seal with the tubular core inner surface. In a thirtieth embodiment, disclosed is a touchless toilet assembly according to any of the preceding embodiments, wherein the spray initiator comprises a downward, outwardly tapered bore portion.

In a thirty-first embodiment, disclosed is a touchless toilet assembly according to any of the preceding embodiments, wherein the spray initiator is configured to discharge the pressurized water in a full cone-shaped spray, hollow cone-shaped spray, square cone-shaped spray, or a pyramid-shaped spray. In a thirty-second embodiment, disclosed is a touchless toilet assembly according to any of the preceding embodiments, wherein the spray initiator is configured to discharge the pressurized water in a square cone-shaped spray or a pyramid-shaped spray. In a thirty-third embodiment, disclosed is a touchless toilet assembly according to any of the preceding embodiments, wherein the spray initiator is configured to discharge the pressurized water into the tubular core at a spray angle of from about 45 degrees to about 130 degrees.

In a thirty-fourth embodiment, disclosed is a touchless toilet assembly according to any of the preceding embodiments, comprising no moving parts. In a thirty-fifth embodiment, disclosed is a touchless toilet assembly according to any of the preceding embodiments, comprising a toilet bowl coupled to the toilet tank.

In a thirty-sixth embodiment, disclosed is a touchless siphon valve assembly for a toilet assembly having a toilet tank, the touchless siphon valve assembly comprising a control assembly and a siphon valve assembly according to any of the preceding embodiments.

In a thirty-seventh embodiment, disclosed is a toilet tank comprising the touchless siphon valve assembly according to any of the preceding embodiments.

The terms "coupled" or "connected" may mean that an element is "attached to" or "associated with" another element. Coupled or connected may mean directly coupled or coupled through one or more other elements. An element may be coupled to an element through two or more other elements in a sequential manner or a non-sequential manner. The term "via" in reference to "via an element" may mean "through" or "by" an element. Coupled or connected or "associated with" may also mean elements not directly or indirectly attached, but that they "go together" in that one may function together with the other.

The terms "upstream" and "downstream" indicate a direction of gas or fluid flow, that is, gas or fluid will flow from upstream to downstream.

The term "towards" in reference to a of point of attachment, may mean at exactly that location or point or, alternatively, may mean closer to that point than to another distinct point, for example "towards a center" means closer to a center than to an edge.

The term "like" means similar and not necessarily exactly like. For instance "ring-like" means generally shaped like a ring, but not necessarily perfectly circular.

The articles "a" and "an" herein refer to one or to more than one (e.g. at least one) of the grammatical object. Any ranges cited herein are inclusive. The term "about" used throughout is used to describe and account for small fluctuations. For instance, "about" may mean the numeric value may be modified by ±0.05%, ±0.1%, ±0.2%, ±0.3%, ±0.4%, ±0.5%, ±1%, ±2%, ±3%, ±4%, or about ±5%. All numeric values are modified by the term "about" whether or not explicitly indicated. Numeric values modified by the term "about" include the specific identified value. For example "about 5.0" includes 5.0.

The term "substantially" is similar to "about" in that the defined term may vary from for example by ±0.05%, ±0.1%, ±0.2%, ±0.3%, ±0.4%, ±0.5%, ±1%, ±2%, ±3%, ±4%, or ±5% of the definition; for example the term "substantially perpendicular" may mean the 90° perpendicular angle may mean "about 90°". The term "generally" may be equivalent to "substantially".

Features described in connection with one embodiment of the disclosure may be used in conjunction with other embodiments, even if not explicitly stated.

Embodiments of the disclosure include any and all parts and/or portions of the embodiments, claims, description and figures. Embodiments of the disclosure also include any and all combinations and/or sub-combinations of embodiments.

The invention claimed is:

1. A touchless toilet assembly comprising a toilet tank, the toilet tank comprising a control assembly; and a siphon valve assembly, wherein the control assembly comprises a capacitive sensor, a controller, and a power source, and the siphon valve assembly comprises a tubular core, a head coupled to and surrounding an upper end of the tubular core, a spray initiator positioned in the head and extending into the tubular core, and a solenoid valve fluidly coupled to the spray initiator, the power source is electrically connected to the capacitive sensor, the controller, and the solenoid valve, the capacitive sensor is configured to detect a first gesture, and to indicate detection of the first gesture to the controller, the controller, upon receiving indication of the first gesture from the capacitive sensor, is configured to instruct the solenoid valve to open to initiate a flush cycle, the siphon valve head comprises an opening having a gate slideably positioned therein, the gate configured to be vertically lifted and lowered between an open and a closed position relative to the opening, respectively, the gate open position is configured to provide for a low volume flush cycle, and the gate closed position is configured to provide for a high volume flush cycle, the controller is electrically coupled to a lift mechanism comprising a multi-arm linkage configured to lift and lower the gate, and the spray initiator, upon opening of the solenoid valve, is configured to spray pressurized water on an entire perimeter of a tubular core inner surface to form a water seal, thereby creating negative pressure in the tubular core and initiating a siphon flow of surrounding water in the toilet tank.

2. The touchless toilet assembly according to claim 1, wherein a lower end of the head defines a siphon valve inlet, a lower end of the tubular core defines a siphon valve outlet, the upper end of the tubular core defines a weir, and the negative pressure created in the tubular core initiates the siphon flow of the toilet tank water through the siphon valve inlet, over the weir, through the tubular core, and out the siphon valve outlet to a toilet bowl to perform a flush.

3. The touchless toilet assembly according to claim 1, configured so that, in the gate closed position, siphon flow of the toilet tank water continues until a surrounding water level drops to a lower end of the head and air enters the siphon valve inlet, thereby breaking the siphon flow.

4. The touchless toilet assembly according to claim 1, wherein the solenoid valve is configured to close after a predetermined time interval.

5. The touchless toilet assembly according to claim 1, comprising a fill valve positioned in the toilet tank, wherein the fill valve is fluidly coupled to the solenoid valve via a first water supply line, and the solenoid valve is fluidly coupled to the spray initiator via second water supply line.

6. The touchless toilet assembly according to claim 1, wherein the capacitive sensor is configured to detect the first gesture and a second gesture, the controller is configured to initiate a low volume flush cycle upon detection of the first gesture, and the controller is configured to initiate a high volume flush cycle upon detection of the second gesture.

7. The touchless toilet assembly according to claim 1, wherein the control assembly comprises an ultrasonic sensor configured to be positioned on a toilet bowl, the controller is configured to determine bowl contents based on information received from the ultrasonic sensor, upon determination of liquid bowl contents, the controller is configured to instruct a low volume flush cycle, and upon determination of solids bowl contents, the controller is configured to instruct a high volume flush cycle.

8. The touchless toilet assembly according to claim 1, wherein the capacitive sensor is configured to detect a third gesture, and to indicate detection of the third gesture to the controller to initiate a cleaning cycle, and the controller, upon receiving indication of the third gesture from the capacitive sensor, is configured to instruct the solenoid valve to remain closed for a predetermined period of time.

9. The touchless toilet assembly according to claim 1, wherein the capacitive sensor is fixed to an interior wall of the toilet tank.

10. The touchless toilet assembly according to claim 1, wherein the capacitive sensor is in wired electrical communication with the controller and the power source, and the controller is in wired electrical communication with the solenoid valve.

11. The touchless toilet assembly according to claim 1, wherein the head comprises a dome-shaped cap or a cylinder-shaped cap.

12. The touchless toilet assembly according to claim 1, wherein the head comprises a plurality of splines extending from an inner surface thereof, the splines configured to locate and hold the head in place on the tubular core upper end.

13. The touchless toilet assembly according to claim 1, wherein the spray initiator is configured to discharge the pressurized water into the tubular core in a spray shaped to form the water seal with the tubular core inner surface.

14. The touchless toilet assembly according to claim 1, wherein the spray initiator is configured to discharge the pressurized water in a full cone-shaped spray, hollow cone-shaped spray, square cone-shaped spray, or a pyramid-shaped spray.

15. The touchless toilet assembly according to claim 1, wherein the spray initiator is configured to discharge the pressurized water into the tubular core at a spray angle of from about 45 degrees to about 130 degrees.

16. A touchless siphon valve assembly for a toilet assembly having a toilet tank, the touchless siphon valve assembly comprising a control assembly; and a siphon valve assembly, wherein the control assembly comprises a capacitive sensor, a controller, and a power source, and the siphon valve assembly comprises a tubular core, a head coupled to and surrounding an upper end of the tubular core, a spray initiator positioned in the head and extending into the tubular core, and a solenoid valve fluidly coupled to the spray initiator, the power source is electrically connected to the capacitive sensor, the controller, and the solenoid valve, the capacitive sensor is configured to detect a first gesture, and to indicate detection of the first gesture to the controller to initiate a flush cycle, the controller, upon receiving indication of the first gesture from the capacitive sensor, is configured to instruct the solenoid valve to open, the siphon valve head comprises an opening having a gate slideably positioned therein, the gate configured to be vertically lifted and lowered between an open and a closed position relative to the opening, respectively, the gate open position is configured to provide for a low volume flush cycle, and the gate closed position is configured to provide for a high volume flush cycle, the controller is electrically coupled to a lift mechanism comprising a multi-arm linkage configured to lift and lower the gate, and the spray initiator, upon opening of the solenoid valve, is configured to spray pressurized water on an entire perimeter of a tubular core inner surface to form a water seal, thereby creating negative pressure in the tubular core and initiating a siphon flow of surrounding water in a toilet tank.

17. A toilet tank comprising the touchless siphon valve assembly according to claim 16.

* * * * *